US006348132B1

(12) United States Patent
Zhang et al.

(10) Patent No.: US 6,348,132 B1
(45) Date of Patent: Feb. 19, 2002

(54) ALKENYL SUCCINIC ANHYDRIDE COMPOSITONS AND THE USE THEREOF

(75) Inventors: Jian Jian Zhang, Wilmington, DE (US); Shiow-Meei Lai, Plymouth Meeting, PA (US)

(73) Assignee: Hercules Incorporated, Wlimington, DE (US)

( * ) Notice: Subject to any disclaimer, the term of this patent is extended or adjusted under 35 U.S.C. 154(b) by 0 days.

(21) Appl. No.: 09/583,129

(22) Filed: May 30, 2000

(51) Int. Cl.[7] ..... D21H 21/16; C07D 307/36

(52) U.S. Cl. ..... 162/158; 162/179; 162/135; 106/287.24; 549/233; 549/255

(58) Field of Search ..... 162/158, 179, 162/135; 106/287.24; 554/148; 549/233, 255

(56) References Cited

U.S. PATENT DOCUMENTS 4,040,900 A 8/1977 Mazzarella et al. ..... 162/158
4,545,855 A * 10/1985 Sweeney ..... 162/179
5,104,486 A * 4/1992 Sweeney ..... 162/158
5,766,417 A 6/1998 Brungardt ..... 162/158

FOREIGN PATENT DOCUMENTS

JP 62-257499 * 11/1987 ..... 162/179

OTHER PUBLICATIONS

Farley, C.E. and Wasser, R.B., "The Sizing of Paper, Second Edition", edited by W.F. Reynolds, Tappi Press, 1989, pp. 51–62.

* cited by examiner

*Primary Examiner*—Peter Chin
(74) *Attorney, Agent, or Firm*—Woodcock Washburn LLP

(57) ABSTRACT

Novel alkenyl succinic anhydride (ASA) compositions and the use thereof. The disclosed ASA compositions may be derived from maleic anhydride and olefins having desirable carbon chain lengths and double bond distributions. The present ASA compositions provide superior paper sizing properties.

18 Claims, 2 Drawing Sheets

ALKENYL SUCCINIC ANHYDRIDE COMPOSITONS AND THE USE THEREOF

FIELD OF THE INVENTION

The present invention relates to novel alkenyl succinic anhydride compositions and the use thereof More particularly, the present invention relates to novel alkenyl succinic anhydride compositions and their use, for example, as paper sizing agents.

BACKGROUND OF THE INVENTION

Alkenyl succinic anhydride (ASA) compounds are used extensively in the papermaking industry as a paper sizing additive for improving properties of paper, including fine paper, recycled linerboard and Gypsum board. ASA compounds have reactive functional groups that are believed to covalently bond to cellulose fiber, and hydrophobic tails that are oriented away from the fiber. The nature and orientation of these hydrophobic tails cause the fiber to repel water.

Commercial sizing agents based on ASA compounds are typically prepared from maleic anhydride and one or more appropriate olefins, generally $C_{14}$ to $C_{22}$ olefins. ASA compounds prepared from maleic anhydride and $C_{16}$ internal olefins, $C_{18}$ internal olefins, and mixtures of $C_{16}$ and $C_{18}$ internal olefins, are among the more widely used ASA compounds.

Although ASA sizing agents are commercially successful, they may frequently suffer from various disadvantages including, for example, the degree of size afforded over wide ranges of addition levels. Accordingly, new and/or better alternatives to prior art paper sizing agents with improved performance, especially off-machine performance, at favorable cost balances, are needed. The present invention is directed to these, as well as other important ends.

SUMMARY OF THE INVENTION

Accordingly, the present invention is directed, in part, to novel paper sizing agents. Specifically, in one embodiment, there are provided processes for sizing paper comprising incorporating in the paper a size composition comprising alkenyl succinic anhydride (ASA) compounds, wherein the ASA compounds are derived from maleic anhydride and a mixture of olefins, wherein the olefin mixture comprises:

from 0% to about 15% of an olefin having about 14 carbon atoms;

from about 15% to about 35% of an olefin having about 15 carbon atoms;

from about 15% to about 35% of an olefin having about 16 carbon atoms;

from about 15% to about 35% of an olefin having about 17 carbon atoms;

from about 10% to about 30% of an olefin having about 18 carbon atoms; and from 0% to about 20% of an olefin having about 19 or more carbon atoms.

Another aspect of the invention relates to processes for sizing paper comprising incorporating in the paper a size composition comprising alkenyl succinic anhydride (ASA) compounds, wherein the ASA compounds are derived from maleic anhydride and a mixture of olefins, wherein the olefin mixture comprises a double bond distribution of:

from 0% to about 15% of $C_1$ olefins;

from about 20% to about 40% of $C_2$ olefins;

from 0% to about 25% of $C_3$ olefins;

from 0% to about 25% of $C_4$ olefins;

from 0% to about 25% of $C_5$ olefins; and from about 20% to about 50% of a mixture of $C_6$ and higher olefins.

Yet another aspect of the invention relates to processes for preparing sized paper comprising:

(a) providing an aqueous pulp slurry which includes a paper sizing composition comprising alkenyl succinic anhydride (ASA) compounds, wherein the ASA compounds are derived from maleic anhydride and a mixture of olefins, wherein the olefin mixture comprises:
- from 0% to about 15% of an olefin having about 14 carbon atoms;
- from about 15% to about 35% of an olefin having about 15 carbon atoms;
- from about 15% to about 35% of an olefin having about 16 carbon atoms;
- from about 15% to about 35% of an olefin having about 17 carbon atoms;
- from about 10% to about 30% of an olefin having about 18 carbon atoms;
- and
- from 0% to about 20% of an olefin having about 19 or more carbon atoms;

and (b) sheeting and drying the pulp slurry from step (a) to obtain the paper.

Still another aspect of the invention relates to processes for preparing sized paper comprising:

(a) providing an aqueous pulp slurry which includes a paper sizing composition comprising alkenyl succinic anhydride (ASA) compounds, wherein the ASA compounds are derived from maleic anhydride and a mixture of olefins, wherein the olefin mixture comprises a double bond distribution of:
- from 0% to about 15% of $C_1$ olefins;
- from about 20% to about 40% Of $C_2$ olefins;
- from 0% to about 25% of $C_3$ olefins;
- from 0% to about 25% of $C_4$ olefins;
- from 0% to about 25% of $C_5$ olefins; and
- from about 20% to about 50% of a mixture of $C_6$ and higher olefins; and (b) sheeting and drying the pulp slurry from step (a) to obtain the paper.

Another aspect of the invention relates to paper sizing compositions comprising alkenyl succinic anhydride compounds derived from maleic anhydride and a mixture of olefins, wherein the olefin mixture comprises:

from 0% to about 15% of an olefin having about 14 carbon atoms;

from about 15% to about 35% of an olefin having about 15 carbon atoms;

from about 15% to about 35% of an olefin having about 16 carbon atoms;

from about 15% to about 35% of an olefin having about 17 carbon atoms;

from about 10% to about 30% of an olefin having about 18 carbon atoms; and from 0% to about 20% of an olefin having about 19 or more carbon atoms.

Yet another aspect of the invention relates to paper sizing compositions comprising alkenyl succinic anhydride compounds derived from maleic anhydride and a mixture of olefins, wherein the olefin mixture comprises a double bond distribution of:

from 0% to about 15% of $C_1$ olefins;

from about 20% to about 40% of $C_2$ olefins;

from 0% to about 25% of $C_3$ olefins;

from 0% to about 25% of $C_4$ olefins;

from 0% to about 25% of $C_5$ olefins; and from about 20% to about 50% of a mixture of $C_6$ and higher olefins.

Still another aspect of the invention relates to processes of preparing paper sizing compositions comprising alkenyl succinic anhydride compounds, wherein the process comprises contacting maleic anhydride with a mixture of olefins, wherein the olefin mixture comprises:

from 0% to about 15% of an olefin having about 14 carbon atoms;

from about 15% to about 35% of an olefin having about 15 carbon atoms;

from about 15% to about 35% of an olefin having about 16 carbon atoms;

from about 15% to about 35% of an olefin having about 17 carbon atoms;

from about 10% to about 30% of an olefin having about 18 carbon atoms; and from 0% to about 20% of an olefin having about 19 or more carbon atoms.

Another aspect of the invention relates to processes of preparing paper sizing compositions comprising alkenyl succinic anhydride compounds, wherein the process comprises contacting maleic anhydride and a mixture of olefins, wherein the olefin mixture comprises a double bond distribution of:

from 0% to about 15% of $C_1$ olefins;

from about 20% to about 40% of $C_2$ olefins;

from 0% to about 25% of $C_3$ olefins;

from 0% to about 25% of $C_4$ olefins;

from 0% to about 25% of $C_5$ olefins; and from about 20% to about 50% of a mixture of $C_6$ and higher olefins.

These and other aspects of the invention will become more apparent from the following detailed description.

DETAILED DESCRIPTION OF THE INVENTION

Figure 1:
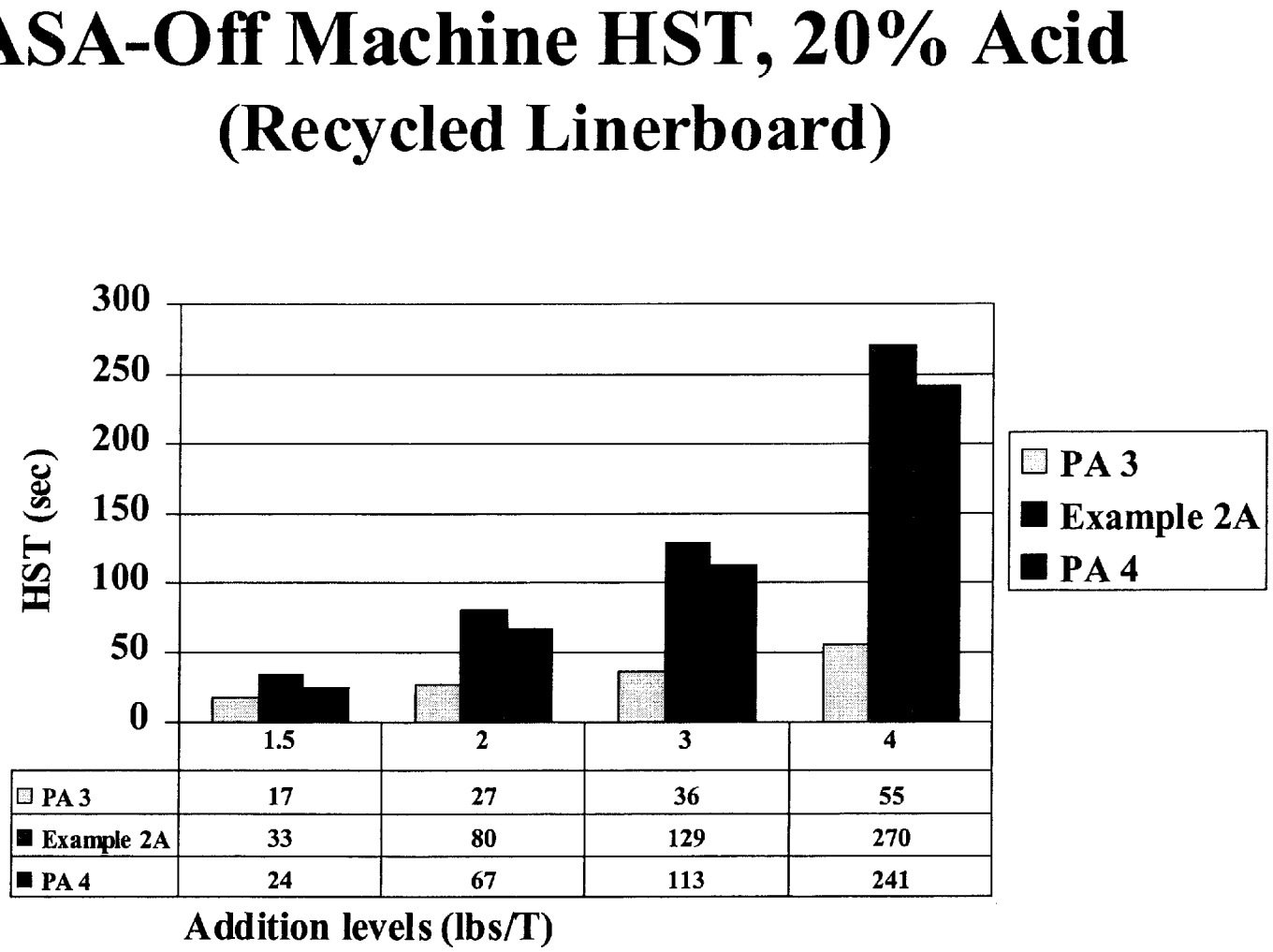
FIGS. 1 and 2 are graphical representations of test procedures of paper sizing compositions according to embodiments of the present invention and paper sizing compositions of the prior art.

The present invention is directed, in part, to novel alkenyl succinic anhydride compositions and their use as paper sizing agents. Broadly speaking, the sizing of paper with compositions of the present invention generally involves incorporating the present compositions into paper. The term "incorporating", as used herein, means that the present compositions may be incorporated into the paper itself (i.e., the compositions serve as internal sizing agents), or may be applied to the surface of the paper (i.e., the compositions serve as surface sizing agents). In preferred embodiments, the present compositions may be employed as internal sizing agents.

The size compositions of the present invention preferably comprise alkenyl succinic anhydride (ASA) compounds. ASA compounds and methods for their preparation are described, for example, in C. E. Farley and R. B. Wasser, "The Sizing of Paper, Second Edition", edited by W. F. Reynolds, Tappi Press, 1989, pages 51–62, the disclosures of which are hereby incorporated herein by reference, in its entirety. ASA compounds are composed of unsaturated hydrocarbon chains containing pendant succinic anhydride groups. Liquid ASA compounds, which are generally preferred in the processes and compositions of the present invention, may be derived from maleic anhydride and suitable olefins. Generally speaking, the ASA compounds may be made by contacting an olefin, preferably an excess of an internal olefin, with maleic anhydride, at a temperature and for a time sufficient to provide the ASA compound as indicated in the following reaction scheme.

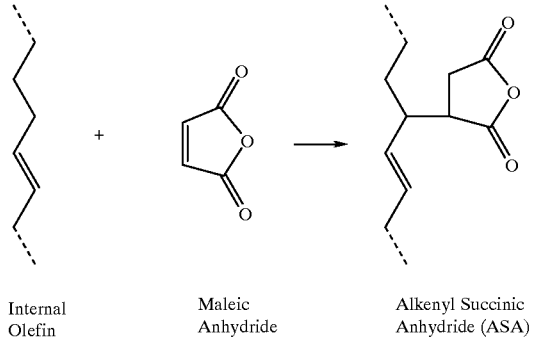

If the olefin to be employed in the preparation of the ASA compounds is not an internal olefin as is the case for example, with α-olefins, it may be preferable to first isomerize the olefins to provide internal olefins.

The olefins that may be used in the preparation of the ASA compounds of the present invention may be linear or branched. Preferably, the olefins may contain at least about 14 carbon atoms. More preferably, the carbon length of olefins used in the preparation of the present ASA compounds may range from about 14 carbon atoms to about 22 carbon atoms, and all combinations and subcombinations of ranges therein. Even more preferably, the ASA compounds employed in the present methods and compositions may be prepared from olefins containing from about 16 to about 19 carbon atoms, with olefins containing from about 16 to about 18 carbon atoms being still more preferred. ASA compounds that may be employed in the present methods and compositions may be prepared, for example, by combining together maleic anhydride and blends of two or more olefins, such as blends of two or more of $C_{14}$, $C_{15}$, $C_{16}$, $C_{17}$, $C_{18}$, $C_{19}$, $C_{20}$, $C_{21}$, and $C_{22}$ olefins, or by separately preparing ASA compounds from maleic anhydride and, for example, $C_{14}$, $C_{15}$, $C_{16}$, $C_{17}$, $C_{18}$, $C_{19}$, $C_{20}$, $C_{21}$, and/or $C_{22}$ olefins, and blending together the separately prepared ASA compounds. Typical structures of ASA compounds are disclosed, for example, in U.S. Pat. No. 4,040,900, the disclosures of which are hereby incorporated herein by reference, in its entirety.

Representative starting olefins that may be reacted with maleic anhydride to prepare ASA compounds for use in the present invention include, for example, tetradecene, pentadecene, hexadecene, heptadecene, octadecene, eicodecene, eicosene, heneicosene, docosene 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-1-decene and 2-n-heptyl-1-octene. Preferred among these olefins are tetradecene, pentadecene, hexadecene, heptadecene, octadecene, eicodecene, eicosene, heneicosene and docosene. Other olefins that would be suitable for use in the preparation of ASA compounds for use in the present invention, in addition to those exemplified above, would be readily apparent to one of ordinary skill in the art, once armed with the teachings of the present application.

In accordance with the present invention, it has been surprisingly and unexpectedly found that certain ASA compounds, especially mixtures of ASA compounds derived from certain mixtures of olefins, possess advantageously improved properties and characteristics. Specifically, it has been found that ASA compounds derived from maleic anhydride and mixtures of olefins, as described in detail herein, may be used as highly effective paper sizing agents. Thus, the ASA compounds may be prepared from a mixture of olefins or, as noted above, the ASA compounds may be prepared individually and blended together to provide the desired mixture of ASA compounds. The particular olefins that may be selected for use in the preparation of the present ASA compounds may vary depending on a variety of factors including, for example, the particular paper being sized, the components of the pulp slurry, and the like. Generally speaking, the particular olefins chosen may be selected based on such criteria as, for example, the length of the olefins (i.e., the number of carbon atoms in the olefin), and/or the location of the double bond in the olefins (i.e., the double bond distribution).

In preferred embodiments, the ASA compounds employed in the methods and compositions of the present invention may be prepared from an olefin mixture that comprises from 0% to about 15% (and all combinations and subcombinations of ranges therein) of an olefin having about 14 carbon atoms, from about 15% to about 35% (and all combinations and subcombinations of ranges therein) of an olefin having about 15 carbon atoms, from about 15% to about 35% (and all combinations and subcombinations of ranges therein) of an olefin having about 16 carbon atoms, from about 15% to about 35% (and all combinations and subcombinations of ranges therein) of an olefin having about 17 carbon atoms, from about 10% to about 30% (and all combinations and subcombinations of ranges therein) of an olefin having about 18 carbon atoms, and from 0% to about 20% (and all combinations and subcombinations of ranges therein) of an olefin having about 19 or more carbon atoms. As used herein, the term "%" refers to weight %, unless otherwise indicated. In addition, the total % olefin in the present mixtures may not exceed 100%. More preferably, the olefin mixture employed in the preparation of the ASA compounds may comprise from about 3% to about 10% of an olefin having about 14 carbon atoms, from about 20% to about 30% of an olefin having about 15 carbon atoms, from about 20% to about 30% of an olefin having about 16 carbon atoms, from about 20% to about 30% of an olefin having about 17 carbon atoms, from about 10% to about 25% of an olefin having about 18 carbon atoms, and from 0% to about 15% of an olefin having about 19 or more carbon atoms. Even more preferably, the olefin mixture employed in the preparation of the ASA compounds may comprise from about 3% to about 7% of an olefin having about 14 carbon atoms, from about 20% to about 27% of an olefin having about 15 carbon atoms, from about 20% to about 27% of an olefin having about 16 carbon atoms, from about 20% to about 26% of an olefin having about 17 carbon atoms, from about 13% to about 20% of an olefin having about 18 carbon atoms, and from 4% to about 10% of an olefin having about 19 or more carbon atoms.

Also in preferred embodiments, the olefin mixture from which the ASA compounds employed in the methods and compositions of the present invention may be prepared preferably comprises a double bond distribution of from 0% to about 15% (and all combinations and subcombinations of ranges therein) of $C_1$ olefins, from about 20% to about 40% (and all combinations and subcombinations of ranges therein) of $C_2$ olefins, from 0% to about 25% (and all combinations and subcombinations of ranges therein) of $C_3$ olefins, from 0% to about 25% (and all combinations and subcombinations of ranges therein) of $C_4$ olefins, from 0% to about 25% (and all combinations and subcombinations of ranges therein) of $C_5$ olefins, and from about 20% to about 50% (and all combinations and subcombinations of ranges therein) of a mixture of $C_6$ and higher olefins. More preferably, the olefin mixture employed in the preparation of the ASA compounds may comprise a double bond distribution of from 0% to about 3% of $C_1$ olefins, from about 25% to about 35% of $C_2$ olefins, from about 10% to about 15% of $C_3$ olefins, from about 10% to about 15% of $C_4$ olefins, from about 10% to about 15% of $C_5$ olefins, and from about 30% to about 44% of a mixture of $C_6$ and higher olefins. Even more preferably, the olefin mixture employed in the preparation of the ASA compounds may comprise a double bond distribution of from 0% to about 2% of $C_1$ olefins, from about 30% to about 35% of $C_2$ olefins, from about 12% to about 15% of $C_3$ olefins, from about 13% to about 14% of $C_4$ olefins, from about 10% to about 12% of $C_5$ olefins, and from about 30% to about 35% of a mixture of $C_6$ and higher olefins.

Olefins that may be employed in the olefin mixtures in the preparation of ASA compounds for use in the present invention may be prepared using standard organic synthetic procedures that would be readily apparent to a person of ordinary skill in the art, once armed with the teachings of the present application. In addition, a wide variety of suitable olefins are commercially available, either individually or as mixtures. Examples of olefin mixtures which may be suitable for use in the preparation of the present sizing compositions include, for example, NEODENE® alpha and internal olefins, commercially available from Shell Chemical Co. Particularly suitable commercially available olefin mixtures are the NEODENE® internal olefin mixtures having olefin chain length components (in weight %) and double bond positional distribution components (in weight %) as set forth in Tables 1 and 2, respectively.

TABLE 1

Composition of Olefin Chain Length

| | $C_{14}$ | $C_{15}$ | $C_{16}$ | $C_{17}$ | $C_{18}$ | $C_{19}$ and higher | MW avg. |
|---|---|---|---|---|---|---|---|
| Average | 4.69 | 24.78 | 24.99 | 22.65 | 16.51 | 6.38 | 230.12 |
| Max | 6.23 | 26.97 | 26.97 | 25.39 | 19.84 | 9.52 | 231.34 |
| Min. | 3.41 | 22.88 | 23.18 | 20.66 | 13.06 | 4.64 | 228.76 |

TABLE 2

Double Bond Positional Distribution

| Sample | $C_1$ olefin | $C_2$ olefin | $C_3$ olefin | $C_4$ olefin | $C_5$ olefin | $C_6$ and higher olefin |
|---|---|---|---|---|---|---|
| 1 | 1.44 | 27.34 | 13.97 | 12.87 | 14.28 | 30.1 |
| 2 | 1.43 | 28.79 | 14.79 | 12.62 | 11.73 | 30.63 |
| 3 | 1.19 | 26.34 | 14.21 | 12.60 | 11.78 | 33.89 |
| 4 | 1.31 | 25.76 | 14.58 | 13.33 | 12.2 | 37.06 |

TABLE 2-continued

| Double Bond Positional Distribution | | | | | | |
|---|---|---|---|---|---|---|
| Sample | $C_1$ olefin | $C_2$ olefin | $C_3$ olefin | $C_4$ olefin | $C_5$ olefin | $C_6$ and higher olefin |
| 5 | 1.21 | 26.04 | 14.54 | 12.96 | 11.2 | 34.05 |
| 6 | 1.33 | 26.56 | 14.45 | 13.13 | 10.06 | 34.27 |

A particularly suitable NEODENE ® product for use in the present methods and compositions is NEODENE ® 1518.

Also in prefered embodiments, the ASA compounds that may be employed in the methods and compositions of the present invention may be prepared by blending two or more mixtures of ASA compounds having different double bond distributions. For example, blending 70 wt % of ASA compounds derived from maleic anhydride and 1% $C_1$, 18% $C_2$, 8% $C_3$ and 73% $C_4$ and greater olefins and 30 wt % of ASA compounds derived from maleic anhydride and 12% $C_1$, 65% 7% $C_3$, and 16% $C_4$ and greater olefins, results in a mixture of ASA compounds double bond distributions within the scope of the present invention, as described herein.

The sizing compositions of the present invention may desirably impart to paper sized therewith particularly advantageous resistance to acidic liquids such as acid inks, citric acid, lactic acid, etc. as compared to paper sized with the sizing agents of the prior art. In addition to the properties already mentioned, the sizing compositions of the present invention may be used alone or, if desired, in combination with other materials such as, for example, alum, as well as pigments, fillers and other ingredients that may be typically added to paper. The sizing compositions of the present invention may also be used in conjunction with other sizing agents so as to obtain additive sizing effects. An advantage of the present sizing compositions is that they do not detract from the strength of the paper and when used with certain adjuncts may, in fact, contribute to the overall strength of the finished sheets. Only mild drying or curing conditions may be required to develop full sizing value.

As would be apparent to the skilled artisan, once armed with the teachings of the present application, the actual use of the present sizing compositions in the manufacture of paper may be subject to a number of variations in techniques, any of which may be further modified in light of the specific requirements of the end-user. Generally speaking, it may be desirable to achieve a uniform dispersal of the sizing composition throughout the fiber slurry, in the form, for example, of minute droplets that can intimately contact the fiber surface. Uniform dispersal may be obtained, for example, by adding the sizing composition to the pulp with vigorous agitation or by adding a previously formed, fully dispersed emulsion. Chemical dispersing agents may also be added to the fiber slurry, if desired.

It may be advantageous to use, in conjunction with the present sizing compositions, a material that is cationic in nature or capable of ionizing or dissociating in such a manner as to produce one or more cations or other positively charged moieties. Such cationic agents have been found useful as a means for aiding in the retention of the present sizing compositions, as well as for bringing the latter into close proximity to the pulp fibers. Among the materials which may be employed as cationic agents in the sizing process are, for example, alum, aluminum chloride, long chain fatty amines, sodium aluminate, substituted polyacrylamide, chromic sulfate, animal glue, cationic thermosetting resins and polyamide polymers. Particularly suitable cationic agents include, for example, cationic starch derivatives, including primary, secondary, tertiary or quaternary amine starch derivatives and other cationic nitrogen substituted starch derivatives, as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products and/or employed in liquid form.

The noted cationic agents may be added to the stock, i.e., the pulp slurry, either prior to, along with, or after the addition of the sizing agent. To achieve maximum distribution, it may be preferable to add the cationic agent subsequent to or in combination with the sizing compositions. The addition to the stock of the sizing compositions and/or cationic agent may take place at any point in the paper making process prior to the ultimate conversion of the wet pulp into a dry web or sheet. Thus, for example, the present sizing compositions may be added to the pulp while the latter is in the headbox, beater, hydropulper and/or stock chest.

To obtain advantageous sizing, it may be desirable to uniformly disperse the sizing agents throughout the fiber slurry in as small a particle size as possible, preferably smaller than 2 micron. This may be achieved, for example, by emulsifying the sizing compositions prior to addition to the stock utilizing mechanical means such as, for example, high speed agitators, mechanical homogenizers, and/or through the addition of a suitable emulsifying agent. Suitable emulsifying agents include, for example, cationic agents as described above, as well as non-cationic emulsifiers including, for example, hydrocolloids as ordinary starches, non-cationic starch derivatives, dextrines, carboxymethyl cellulose, gum arabic, gelatin, and polyvinyl alcohol, as well as various surfactants. Examples of suitable surfactants include, for example, polyoxyethylene sorbitan trioleate, polyoxyethylene sorbitol hexaoleate, polyoxyethylene sorbitol laurate, and polyoxyethylene sorbitol oleate-laurate. When such non-cationic emulsifiers are used, it may be desirable to separately add a cationic agent to the pulp slurry after the addition of the emulsified sizing agent. In preparing these emulsions with the use of an emulsifier, the latter may be first dispersed in water and the sizing composition may then be introduced along with vigorous agitation. Alternatively, the emulsification techniques described, for example, in U.S. Pat. No. 4,040,900, the disclosures of which are hereby incorporated herein by reference, in their entirety, may be employed.

In certain circumstances, further improvements in the water resistance of the paper prepared with the sizing compositions of the present invention may be obtained, for example, by curing the resulting webs, sheets, or molded products. This curing process may involve heating the paper to a temperature and for a time suitable to obtain the desired improved water resistance.

Generally speaking, the paper may be heated to a temperatures of from about 80° C. to about 150° C. for a period of from about 1 to about 60 minutes. However, it should be noted that post curing may not be necessary to the successful operation of this invention.

The sizing compositions of the present invention may, of course, be successfully utilized for the sizing of paper prepared from all types of both cellulosic and combinations of cellulosic with non-cellulosic fibers. The cellulosic fibers which may be used include, for example, bleached and unbleached sulfate (kraft), bleached and unbleached sulfite, bleached and unbleached soda, neutral sulfite, semi-chemical chemiground-wood, ground wood, and any 10 combination of these fibers. These designations refer to wood pulp fibers which have been prepared by any of a variety of processes that are typically used in the pulp and paper industry. In addition, synthetic fibers of the viscose rayon or regenerated cellulose type may also be used.

All types of pigments and fillers may be added to the paper which is to be sized using the methods and compositions of the present invention. Such materials include, for example, clay, talc, titanium dioxide, calcium carbonate, calcium sulfate, and diatomaceous earths. Other additives, including, for example, alum, as well as other sizing agents, may also be included in the present methods and compositions.

The amount of the present sizing composition that may be employed to size paper may vary depending, for example, on the particular sizing composition employed, the particular pulp involved, the specific operating conditions, the contemplated end-use of the paper, and the like. Generally speaking, smaller amounts of the sizing compositions may be used initially and, if necessary, increased until the desired sizing effect under the circumstances is reached. Desirable concentrations of the sizing compositions that may be employed in the present methods and compositions, based on the dry weight of the pulp in the finished sheet or web, may range 25 from about 0.5 to about 20 pounds per ton (lbs/T), and all combinations and subcombinations of ranges therein. In preferred form, the present sizing compositions may be employed at a concentration of from about 0.8 to about 10 lbs/T, with a concentration of from about 1 to about 5 lbs/T being more preferred. In even more preferred embodiments, the paper sizing compositions may be employed in a concentration of from about 1 to about 2 lbs/T.

If a cationic agent is also employed in the present methods and compositions, the concentration of cationic agent may vary depending, for example, on the particular sizing composition employed, the particular cationic agent employed, the particular pulp involved, the specific operating conditions, the contemplated end-use of the paper, and the like. Generally speaking, smaller amounts of the cationic agent may be used initially and, if necessary, increased until the desired effect under the circumstances is reached. Desirable concentrations of the cationic agent that may be employed in the present methods and compositions, based on the dry weight of the pulp in the finished sheet or web, may range from about 0.5 to about 2.0 parts, and all combinations and subcombinations of ranges therein, per 1.0 part of sizing composition is usually adequate.

The sizing compositions of the present invention may also be used to impart water-repellency to cellulosic fabrics. These water-repellent compositions may be applied to the cloth in aqueous emulsions similar to those used for paper sizing. The emulsion may be sprayed onto the fabric or the fabric may be dipped into the emulsion in order to distribute the material evenly throughout the fabric. The impregnated fabric may then be withdrawn from the solution and air dried. After air drying, the cloth may be heated, preferably to a temperature and for a time to achieve the desired curing of the impregnated agent within the cloth. Generally speaking, the cloth may be heated to a temperature in excess of 100° C. preferably to a temperature of about 125° C. for a period of from about 15 to about 20 minutes. At lower temperatures, longer periods of time may be required to effect the curing process. To be commercially practical, the curing time should be as short as possible, and preferably, less than about one hour. At higher temperatures, the heat curing may be accomplished in shorter periods of time. The upper limit of temperature at which the heat curing process may be carried out may generally be limited by the temperatures at which fabrics begin to brown or become discolored. The concentration of the present compositions that may be employed as a water repellant may vary depending, for example, on the particular composition employed, the particular fabric employed, the desired end-use of the fabric, and the like. Generally speaking, smaller amounts of the present compositions may be used initially and, if necessary, increased until the desired water repellant effect under the circumstances is reached. Desirable concentrations of the compositions that may be employed to achieve water repellency, based on the weight of the fabric, may range from about 0.7 to about 2.5%, and all combinations and subcombinations of ranges therein.

The invention is further described in the following examples. All of the examples are actual examples. These examples are for illustrative purposes only, and are not to be construed as limiting the appended claims.

EXAMPLE 1

This example includes a description of a comparison of olefin mixtures which may be employed in the preparation of ASA compounds for use in the methods and compositions of the present invention and ASA compounds employed in the prior art. Specifically, set forth in Table 3 below is a comparison, as measured in weight %, of the $C_1$, $C_2$, $C_3$, $C_4$, $C_5$, and $C_6$ and higher components in olefin mixtures that may be used in the preparation of ASA compounds employed in the present invention (Examples 1A and 1B), and olefin mixtures that may be used to prepare ASA compounds employed in the prior art (PA 1 and PA 2). The olefins of Examples 1A and 1B are NEODENE internal olefins, obtained from Shell Chemical Co. PA 1 was obtained from BP Amoco Chemicals and PA 2 is a GULFTENE™ product commercially available from Chevron Chemicals Co.

TABLE 3

Double Bond Positional Distribution

| Sample | $C_1$ | $C_2$ | $C_3$ | $C_4$ | $C_5$ | $C_6$ and higher |
|---|---|---|---|---|---|---|
| Example 1A | 1.86 | 31.27 | 14.95 | 13.15 | 13.93 | 24.91 |
| Example 1B | 1.31 | 26.73 | 14.70 | 13.10 | 9.42 | 34.83 |
| PA 1 | 1.26 | 10.61 | 7.74 | 12.23 | 10.36 | 57.80 |
| PA 2 | 0.54 | 11.47 | 9.00 | 12.77 | 12.19 | 54.03 |

EXAMPLE 2

This example includes a description of a comparison of the double bond distribution in ASA compounds for use in methods and compositions within the scope of the present invention and ASA compounds used in the prior art. Specifically, set forth in Table 4 below is a comparison, as measured in weight %, of the $C_1$, $C_2$, $C_3$, and $C_4$ and higher components in the present ASA compounds (Example 2A), and ASA compounds of the prior art (PA 3, PA 4 and PA 5). Example 2A was obtained from maleic anhydride and the olefin mixture of Example 1A. PA 3 was derived from maleic anhydride and $C_{16}$ internal olefins obtained from Dixie Chemical Inc. PA 4 and PA 5 were derived from maleic anhydride and $C_{16}$ and $C_{18}$ internal olefins, respectively, obtained from Bercen Inc.

TABLE 4

Double Bond Positional Distribution

| Sample | $C_1$ | $C_2$ | $C_3$ | $C_4$ and greater |
|---|---|---|---|---|
| Example 2A | 3 | 30 | 13 | 54 |
| PA 3 | 1 | 18 | 8 | 73 |
| PA 4 | 12 | 65 | 7 | 16 |
| PA 5 | 9 | 67 | 7 | 16 |

EXAMPLE 3

This example includes a description of test procedures of paper sizing compositions within the scope of the present invention and paper sizing compositions of the prior art.

Figure 2:
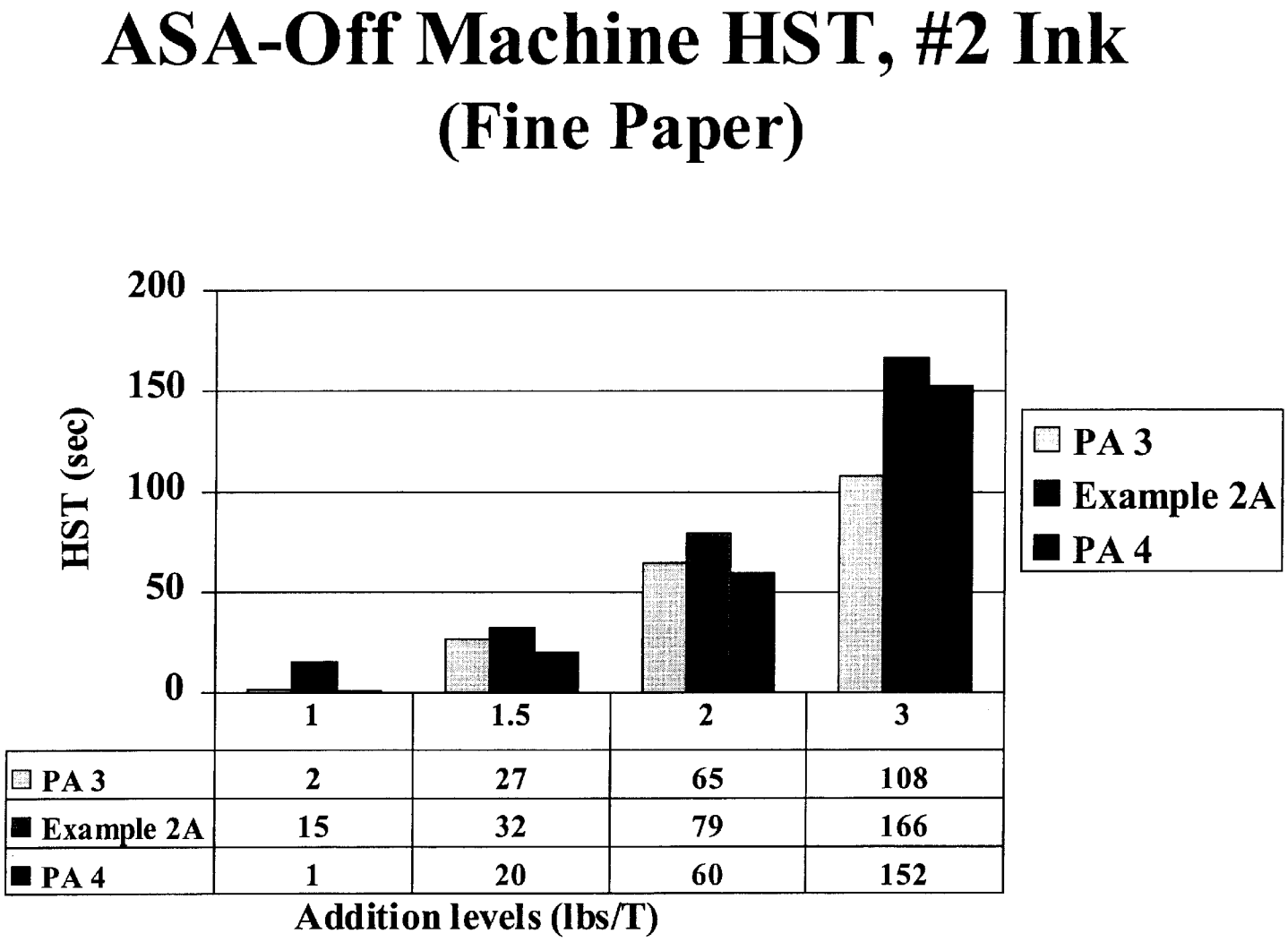

The sizing compositions of Example 2A, PA 3 and PA 4 were tested for paper sizing efficiency on recycled linerboard and fine paper, at several addition levels. The evaluation data are set forth in FIGS. 1 and 2. The data indicate that Example 2A, which is a sizing composition within the scope of the present invention, outperformed PA 3 and PA 4, which are sizing compositions of the prior art, at low size furnishes. Example 2A outperformed both PA 3 and PA 4 at all addition levels (see FIGS. 1 and 2), and was significantly better than PA 3 at high addition levels in the fine paper study (see FIG. 2).

The disclosures of each patent, patent application and publication cited or described in this document are hereby incorporated herein by reference, in their entirety.

Various modification of the invention, in addition to those described herein, will be apparent to those skilled in the art from the foregoing description. Such modifications are also intended to fall within the scope of the appended claims.

What is claimed is:

1. A process for sizing paper comprising incorporating in the paper a size composition comprising alkenyl succinic anhydride (ASA) compounds, wherein said ASA compounds are derived from maleic anhydride and a mixture of olefins, wherein said olefin mixture comprises:

from about 3% to about 10% of an olefin having about 14 carbon atoms;

from about 20% to about 30% of an olefin having about 15 carbon atoms;

from about 20% to about 30% of an olefin having about 16 carbon atoms;

from about 20% to about 30% of an olefin having about 17 carbon atoms;

from about 10% to about 25% of an olefin having about 18 carbon atoms; and from 0% to about 15% of an olefin having about 19 or more carbon atoms.

2. A process according to claim 1 wherein said olefin mixture comprises:

from about 3% to about 7% of an olefin having about 14 carbon atoms;

from about 20% to about 27% of an olefin having about 15 carbon atoms;

from about 20% to about 27% of an olefin having about 16 carbon atoms;

from about 20% to about 26% of an olefin having about 17 carbon atoms;

from about 13% to about 20% of an olefin having about 18 carbon atoms; and from about 4% to about 10% of an olefin having about 19 or more carbon atoms.

3. A process according to claim 1 wherein said size composition is incorporated in the paper internally.

4. Sized paper prepared according to the process of claim 1.

5. A process for sizing paper comprising incorporating in the paper a size composition comprising alkenyl succinic anhydride (ASA) compounds, wherein said ASA compounds are derived from maleic anhydride and a mixture of olefins, wherein said olefin mixture comprises a double bond distribution of:

from 0% to about 2% of $C_1$ olefins;

from about 30% to about 35% of $C_2$ olefins;

from about 12% to about 15% of $C_3$ olefins;

from about 13% to about 14% of $C_4$ olefins;

from about 10% to about 12% of $C_5$ olefins; and from about 30% to about 35% of a mixture of $C_6$ and higher olefins.

6. A process according to claim 5 wherein said size composition is incorporated in the paper internally.

7. Sized paper prepared according to the process of claim 5.

8. A process for preparing sized paper comprising:

(a) providing an aqueous pulp slurry which includes a paper sizing composition comprising alkenyl succinic anhydride (ASA) compounds, wherein said ASA compounds are derived from maleic anhydride and a mixture of olefins, wherein said olefin mixture comprises:

from about 3% to about 10% of an olefin having about 14 carbon atoms;

from about 20% to about 30% of an olefin having about 15 carbon atoms;

from about 20% to about 30% of an olefin having about 16 carbon atoms;

from about 20% to about 30% of an olefin having about 17 carbon atoms;

from about 10% to about 25% of an olefin having about 18 carbon atoms; and from 0% to about 15% of an olefin having about 19 or more carbon atoms; and (b) sheeting and drying said pulp slurry from step (a) to obtain the paper.

9. A process according to claim 8 wherein said olefin mixture comprises:

from about 3% to about 7% of an olefin having about 14 carbon atoms;

from about 20% to about 27% of an olefin having about 15 carbon atoms;

from about 20% to about 27% of an olefin having about 16 carbon atoms;

from about 20% to about 26% of an olefin having about 17 carbon atoms;

from about 13% to about 20% of an olefin having about 18 carbon atoms; and from about 4% to about 10% of an olefin having about 19 or more carbon atoms.

10. Paper prepared according to the process of claim 8.

11. A process for preparing sized paper comprising:

(a) providing an aqueous pulp slurry which includes a paper sizing composition comprising alkenyl succinic anhydride (ASA) compounds, wherein said ASA compounds are derived from maleic anhydride and a mixture of olefins, wherein said olefin mixture comprises a double bond distribution of:

from 0% to about 2% of $C_1$ olefins;

from about 30% to about 35% of $C_2$ olefins;

from about 12% to about 15% of $C_3$ olefins;

from about 13% to about 14% of $C_4$ olefins;

from about 10% to about 12% of $C_5$ olefins; and from about 30% to about 35% of a mixture of $C_6$ and higher olefins; and (b) sheeting and drying said pulp slurry from step (a) to obtain the paper.

12. Paper prepared according to the process of claim 11.

13. A paper sizing composition comprising alkenyl succinic anhydride compounds derived from maleic anhydride and a mixture of olefins, wherein said olefin mixture comprises:

from about 3% to about 10% of an olefin having about 14 carbon atoms;

from about 20% to about 30% of an olefin having about 15 carbon atoms;

from about 20% to about 30% of an olefin having about 16 carbon atoms;

from about 20% to about 30% of an olefin having about 17 carbon atoms;

from about 10% to about 25% of an olefin having about 18 carbon atoms; and from 0% to about 15% of an olefin having about 19 or more carbon atoms.

14. A composition according to claim 13 wherein said olefin mixture comprises:

from about 3% to about 7% of an olefin having about 14 carbon atoms;

from about 20% to about 27% of an olefin having about 15 carbon atoms;

from about 20% to about 27% of an olefin having about 16 carbon atoms;

from about 20% to about 26% of an olefin having about 17 carbon atoms;

from about 13% to about 20% of an olefin having about 18 carbon atoms; and from about 4% to about 10% of an olefin having about 19 or more carbon atoms.

15. A paper sizing composition comprising alkenyl succinic anhydride compounds derived from maleic anhydride and a mixture of olefins, wherein said olefin mixture comprises a double bond distribution of:

from 0% to about 2% of $C_1$ olefins;

from about 30% to about 35% of $C_2$ olefins;

from about 12% to about 15% of $C_3$ olefins;

from about 13% to about 14% of $C_4$ olefins;

from about 10% to about 12% of $C_5$ olefins; and from about 30% to about 35% of a mixture of $C_6$ and higher olefins.

16. A process of preparing a paper sizing composition comprising alkenyl succinic anhydride compounds, wherein the process comprises reacting maleic anhydride with a mixture of olefins, wherein said olefin mixture comprises:

from about 3% to about 10% of an olefin having about 14 carbon atoms;

from about 20% to about 30% of an olefin having about 15 carbon atoms;

from about 20% to about 30% of an olefin having about 16 carbon atoms;

from about 20% to about 30% of an olefin having about 17 carbon atoms;

from about 10% to about 25% of an olefin having about 18 carbon atoms; and from 0% to about 15% of an olefin having about 19 or more carbon atoms.

17. Paper sizing composition prepared according to the process of claim 16.

18. A process of preparing a paper sizing composition comprising alkenyl succinic anhydride compounds, wherein the process comprises reacting maleic anhydride and a mixture of olefins, wherein said olefin mixture comprises a double bond distribution of:

from 0% to about 2% of $C_1$ olefins;

from about 30% to about 35% of $C_2$ olefins;

from about 12% to about 15% of $C_3$ olefins;

from about 13% to about 14% of $C_4$ olefins;

from about 10% to about 12% of $C_5$ olefins; and from about 30% to about 35% of a mixture of $C_6$ and higher olefins.

* * * * *

UNITED STATES PATENT AND TRADEMARK OFFICE

CERTIFICATE OF CORRECTION

PATENT NO. : 6,348,132 B1 
DATED : February 19, 2002
INVENTOR(S) : Jian Jian Zhang and Shiow-Meei Lai It is certified that error appears in the above-identified patent and that said Letters Patent is hereby corrected as shown below:

Column 7,
Line 20, following "65%", please insert -- $C_2$ -- therefor.
Line 21, following "compounds", please insert -- having -- therefor.

Column 9,
Line 4, please delete "10".

Signed and Sealed this

Eleventh Day of January, 2005

JON W. DUDAS
*Director of the United States Patent and Trademark Office*